US005230379A

United States Patent [19]

Voss

[11] Patent Number: 5,230,379

[45] Date of Patent: Jul. 27, 1993

[54] COUNTERGRAVITY CASTING APPARATUS AND METHOD

[75] Inventor: Karl D. Voss, Farmington Hills, Mich.

[73] Assignee: CMI-International, Inc., Southfield, Mich.

[21] Appl. No.: 821,767

[22] Filed: Jan. 15, 1992

[51] Int. Cl.[5] ..... B22D 18/06

[52] U.S. Cl. ..... 164/63; 164/255

[58] Field of Search ..... 164/63, 255, 119, 306, 164/254

[56] References Cited

U.S. PATENT DOCUMENTS

| | | | |
|---|---|---|---|
| 3,865,177 | 2/1975 | Ahacic | 164/133 |
| 3,905,419 | 9/1975 | Tenner | 164/337 |
| 4,791,977 | 12/1988 | Chandley | 164/63 |
| 4,865,113 | 9/1989 | Voss et al. | 164/63 |
| 4,989,662 | 2/1991 | Sabraw | 164/58.1 |

*Primary Examiner*—Kuang Y. Lin

*Attorney, Agent, or Firm*—Reising, Ethington, Barnard, Perry & Milton

[57] ABSTRACT

A vacuum-assisted countergravity casting apparatus 10 includes a casting mold 14 disposed on a cheek mold member 28 and supported within a vacuum box 40. The mold 14 includes bottom feed gates 24 communicating with a cavity 22 within the mold 14. The cheek mold member 28 has distribution channels 30 formed in its upper surface 32 and includes a bottom ingate passage 34. A feed stalk 42 is connected to the ingate passage 34 for immersion into an underlying supply of molten metal 12. Actuation of vacuum pump 52 produces a vacuum within the vacuum chamber 46 and draws the molten metal upwardly to fill the cavity 22. Once filled, the mold 14 is pushed sideways on the cheek 28 by ram 68 causing the feed gates 24 to move out of registry with the distribution channels 30. The molten metal is thereby retained in the cavity 22 without assistance from the vacuum.

16 Claims, 2 Drawing Sheets

FIG-1
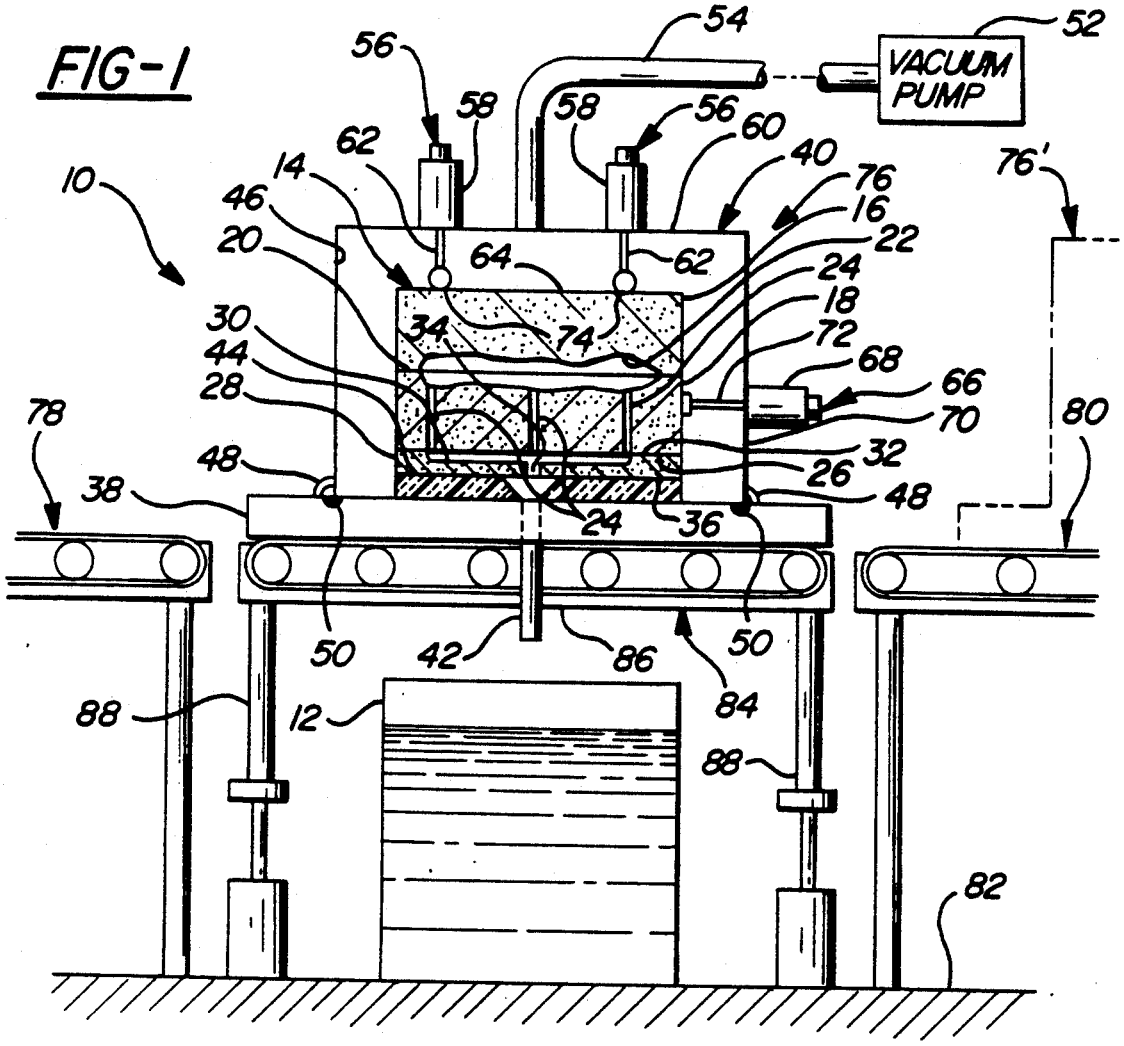
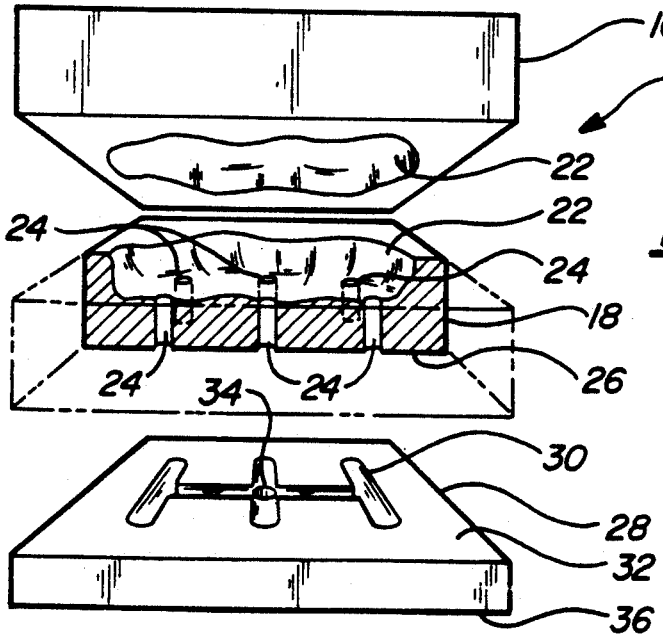
FIG-2

FIG-3
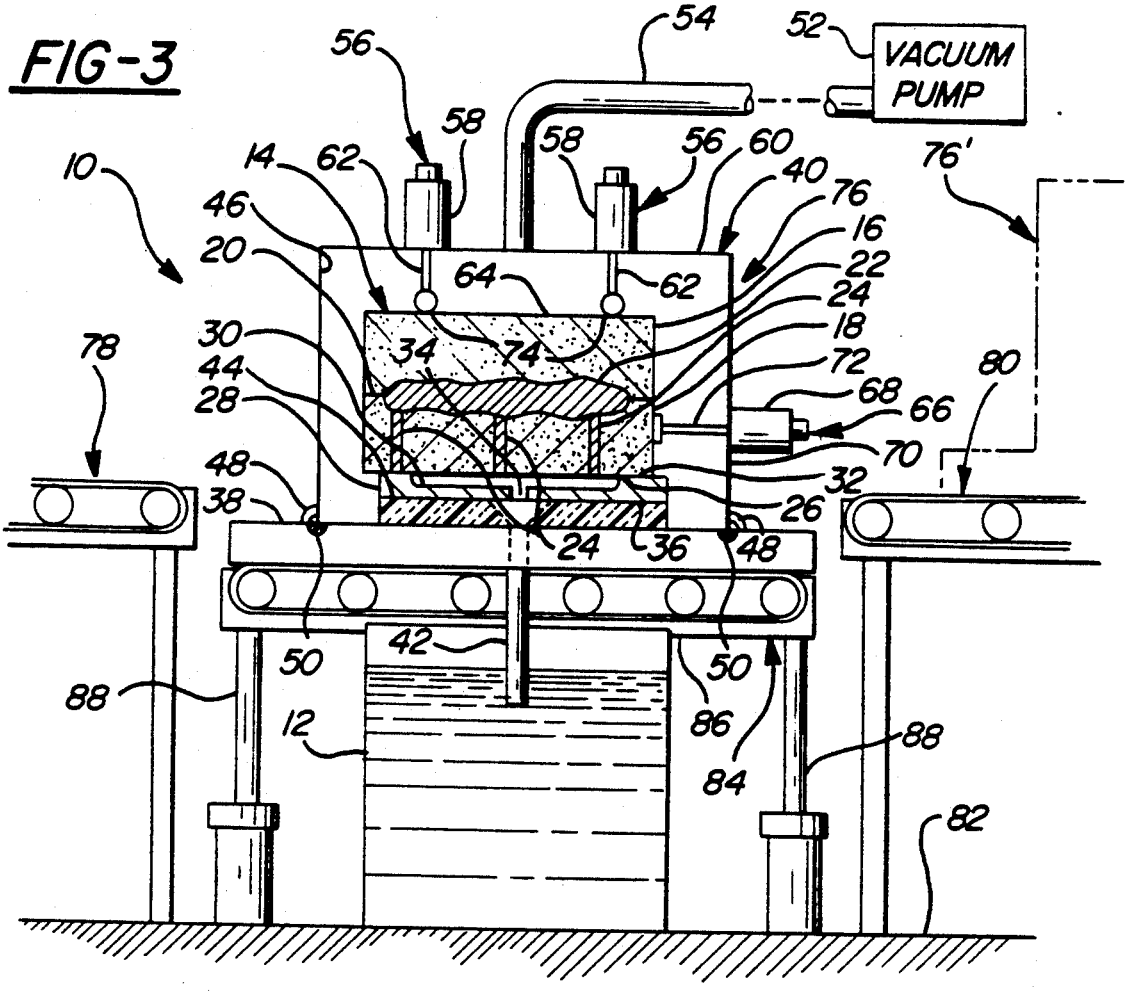
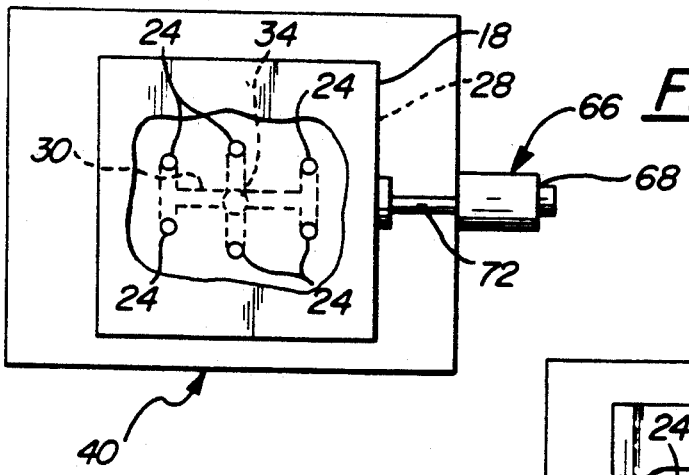
FIG-4
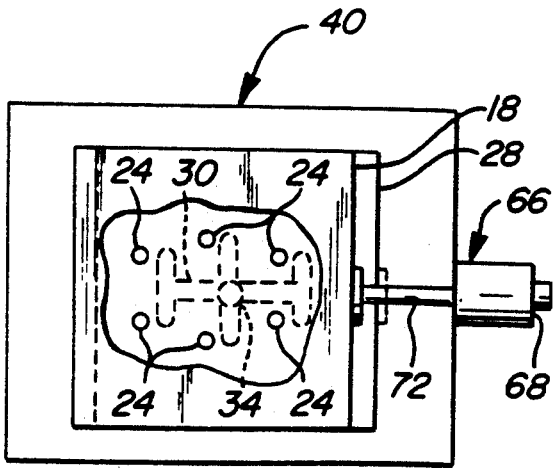
FIG-5

COUNTERGRAVITY CASTING APPARATUS AND METHOD

BACKGROUND OF INVENTION

1. Field of the Invention

The present invention relates to a countergravity metal casting method and apparatus and, more particularly, to such a method and apparatus having displaceable mold portions for controlling the flow of metal into and out of the mold.

2. Description of the Related Prior Art

Vacuum-assisted, countergravity casting of molten metal has been successful in producing high-quality thin-walled castings. Examples of such processes are disclosed in the U.S. Pat No. 4,719,977, granted Dec. 20, 1988, To Chandley; U.S. Pat No.4,865,113, granted Sep. 12, 1989, to Voss et al.; and U.S. Pat No. 4,989,662, granted Feb. 5, 1991, to Spraw.

With these countergravity casting systems, a casting mold is formed with a feed gate extending up from the bottom of the mold and into a casting cavity therein. The feed gates are then placed in communication with an underlying metal source and a vacuum is applied to the casting cavity to draw the molten metal upwardly and fill the cavity. Since the metal is rising in the mold under low pressure from the bottom, excessive turbulence is avoided in the mold resulting in a cleaner, higher quality casting as compared to conventional gravity-cast molds.

A major drawback of known vacuum-assisted countergravity casting systems, however, is that the vacuum must be maintained until at least the metal in the feed gates solidifies or else the molten metal will drain out of the cavity upon discontinuing the vacuum. Consequently, the cycle time for producing a countergravity-filled casting typically exceeds the cycle time for producing a comparative gravity-fed casting.

SUMMARY OF THE INVENTION AND ADVANTAGES

The present invention provides a method for the vacuum-assisted countergravity casting of molten metal from an underlying source of the molten metal into a mold cavity of an above-situated casting mold. The method includes forming substantially horizontal distribution channels in a top side of a cheek mold and forming an ingate passage extending upwardly from a bottom side of the cheek mold and communicating with the distribution channels. A plurality of feed gates are formed in the mold and extend upwardly from the bottom side thereof and into the cavity of the mold. The bottom side of the mold is then positioned into engagement with the top side of the cheek so that the feed gates of the mold are in registry with the distribution channels of the cheek. A differential pressure is then applied between the metal cavity and the underlying source of molten metal sufficient to urge the molten metal upwardly through the ingate and distribution channels and then into the cavity through the plurality of feed gates to fill the cavity with the molten metal. Once the cavity has been filled, the mold is displaced on the cheek in order to move the feed gates out of registry with the distribution channels for retaining the molten metal in the cavity independently of the influence of the applied differential pressure.

In an apparatus according to the subject invention, the cheek mold member is formed with the ingate passage extending upwardly from the bottom side of the cheek and further formed with the generally horizontal outwardly extending distribution channels formed in the top side of the cheek and communicating with the ingate passage. The casting mold has a cavity therein and is formed with the plurality of feed gates extending upwardly from the bottom side of the mold and into the cavity. The bottom side of the mold is supported on the top side of the cheek with the feed gates in registry with the distribution channels. Means are provided for applying a differential pressure between the cavity and the underlying source of the molten metal for filling the cavity with the molten metal. The characterizing feature of the present invention is mold displacement means for displacing the casting mold on the cheek once the cavity has been filled so as to misalign the feed gates and distribution channels for retaining the molten metal in the cavity independently of the applied differential pressure.

The subject invention retains all of the advantages of low-pressure countergravity casting by producing clean, high-quality castings while, at the same time, overcoming the disadvantages of prior art countergravity casting systems by providing a means and process by which the casting mold is displaced on the cheek mold after the cavity has been filled. By displacing the mold, the applied pressure can be discontinued without having the molten metal drain out of the cavity and further allows the molten metal in the gating system to return back into the melt for more uniform temperature and chemistry control of the molten metal.

BRIEF DESCRIPTION OF THE DRAWINGS

Other advantages of the subject invention will be readily appreciated as the same becomes better understood by reference to the following detailed description when considered in connection with the accompanying drawings wherein:

FIG. 1 is a schematic front view of an apparatus constructed in accordance with the present invention;

FIG. 2 is a schematic perspective view of the subject casting mold shown partially in cross section and the cheek mold member;

FIG. 3 is a view like FIG. 1 but with the feed tube immersed in the bath of molten metal;

FIG. 4 is a top view of the casting mold and cheek with the cope section removed showing the feed gates of the casting mold in registry with the distribution channels; and FIG. 5 is a view like FIG. 4, but with the casting mold displaced on the cheek mold member so that the feed gates are out of registry with the distribution channels.

DESCRIPTION OF THE PREFERRED EMBODIMENT

A vacuum-assisted countergravity casting apparatus according to the present invention is generally shown at 10 in FIG. 1 and includes a supply of molten metal 12, such as a vessel of iron or aluminum, to be countergravity cast with vacuum assistance up into a casting mold 14.

The mold 14 is gas-permeable and includes an upper cope portion 16 and lower drag portion 18 joined at parting line 20 and defining a mold cavity 22 therebetween. The drag portion 18 includes a plurality of feed gates or pin gates 24 extending upwardly from a bottom side 26 of the drag 18 and into the mold cavity 22 for admitting the molten metal 12 into the cavity 22.

The mold portions 16,18 are supported on a cheek mold member 28 having a series of distribution channels 30 formed as recesses in a top side 32 of the cheek 28. The cheek 28 may be formed of the same material and process as the mold 14. An ingate passage 34 extends up from an underside 36 of the cheek 28 and communicates with the distribution channels 30. In preparation for filling the cavity 22 with the molten metal 12, the feed gates 24 of the mold 14 are registered or aligned with their corresponding distribution channels 30 of the cheek 28 as shown in FIGS. 1 and 4. The distribution channels 30 thus serve to communicate the feed gates 24 of the mold 14 with the ingate passage 34 of the cheek when registered.

The casting mold 14 and cheek 28 are supported as a unit on vacuum plate 38 and enclosed by a vacuum box 40. The plate 38 and box 40 define a vacuum chamber 46 therein. A feed stalk or tube 42 is connected to the ingate passage 34 of the cheek 28 and extends downwardly therefrom through the vacuum plate 38 for immersion into the underlying supply of molten metal 12. A heat-resistant seal or gasket 44, such as a fiber fax seal, is disposed between the cheek 28 and the vacuum plate 38 for sealing the vacuum chamber 46 against leakage around the feed stalk 42. The vacuum box 40 is clamped to the vacuum plate 38 by clamps 48 and an air-tight seal perfected therebetween by high-temperature rubber seals 50. The vacuum chamber 46 communicates with a vacuum source 52, such as a vacuum pump, through vacuum line 54.

The cope portion 16 is pressed into sealing engagement with the lower drag portion 18 and against the cheek 28 by mold clamps 56. The mold clamps 56 comprise hydraulic rams 58 supported vertically by a top wall 60 of the vacuum box 40. The rams 58 have extendable shafts or plungers 62 which are reciprocally slidable through the top wall 60 for pressing engagement with an upper surface 64 of the mold 14.

The apparatus 10 also includes mold displacement means 66 for displacing the casting mold 14 on the cheek 28, as shown in FIGS. 3 and 5, once the mold cavity 22 has been filled with the molten metal 12 in order to misalign the feed gates 24 with the distribution channels for retaining the molten metal 12 in the cavity 22 independently of the applied vacuum force to the mold 14. The mold displacement means 66 comprises one or more hydraulic rams 68 supported horizontally by a side wall 70 of the vacuum box 40. The rams 68 include a shaft or plunger 72 which is reciprocally slidable through the side wall 70 for engaging an adjacent side of the drag portion 18 of the mold 14 to slide the mold 14 on the cheek 28. To accommodate the sliding movement of the mold 14, the shafts 62 of the vertical mold clamps 56 are provided with rollers 74 at their distal ends for rollingly engaging the upper surface 64 of the mold 14.

The vacuum box 40, plate 38, casting mold 14, cheek 28, and feed stalk 42 are supported as a casting unit, generally denoted 76, on a conveyor means 78 for moving the unit 76 into and out of casting position over the underlying source of the molten metal 12. The conveyor means 78 includes a conveyor line 80 and an intermediate lift table 84 for supporting the casting unit 76 in position directly over the underlying supply of molten metal 12 between a raised position (FIG. 1) in which the feed stalk 42 is withdrawn from the supply of molten metal 12, and a lowered position (FIG. 3) in which the feed stalk 42 is immersed in the molten metal 12. The lift table 84 comprises a platform 86 supported off the support surface 82 by hydraulic lifts 88 mounted to the support surface 82. The hydraulic lifts 88, as well as the hydraulic rams 58,68, are connected to suitable hydraulic pumps, as is conventional for such devices.

In a method according to the present invention, the cope and drag portions 16,18, as well as the cheek 28, are made of resin-bonded sand in accordance with known mold practice, with the mold 14 including the cavity 22 and feed gates 24 and the cheek mold 28 including the distribution channels 30 and ingate passage 34. The cope and drag portions 16,18 are assembled and positioned on the cheek 28 with the feed gates 24 and distribution channels 30 in registry (FIGS. 1 and 4). The casting mold 14 and cheek 28 are disposed as a unit within the vacuum chamber 22 supported on the conveyor line 80. The entire casting unit 76 is then conveyed onto the lift table 84, as shown in FIG. 1, with the hydraulic rams 58 having been actuated to clamp the mold portions 16,18 together and against the cheek 28 and form fluid-tight seals therebetween.

The hydraulic lifts 88 are actuated to lower the casting unit 76 and immerse the feed stalk 42 in the supply of molten metal 12, as shown in FIG. 3. A vacuum is then drawn in the chamber 22 with force sufficient to urge the molten metal 12 up the feed stalk 42, ingate passage 34 and distribution channels 30 and then into the cavity 22 until the cavity 22 is filled with the molten metal 12. Once the cavity 22 is filled and while the metal in the feed gates 24 is still molten, the hydraulic ram 68 is actuated to push the mold 14 on the cheek 28 from the position shown in FIG. 1 and 4 to the position shown in FIGS. 3 and 5, causing the feed gates 24 to be displaced out of registry with the distribution channels 30. Misalignment of the feed gates 24 and distribution channels 30 blocks the flow of molten metal back out of the mold cavity 22.

Following displacement of the mold 14, the vacuum may be discontinued, thereby permitting the molten metal present in the distribution channels 30, ingate passage 34 and feed stalk 42 to drain back into the furnace 12. The hydraulic lifts 88 are then again actuated for lifting the completed casting unit 76 upwardly to the position shown in FIG. 1. The completed casting unit 76 is then conveyed to a next station for cooling while, at the same time, a next successive casting unit 76' is conveyed onto the lift table and readied for casting.

Although the mold clamping means 56, mold displacement means 66 and lift table 84 have been described as being provided with hydraulically actuated devices, it will be appreciated that other mechanical, pneumatic or electrical devices would be suitable. Furthermore, the conveyor means 78 would include devices other than conveyor belts or rollers, as depicted in the FIGURES.

The invention has been described in an illustrative manner and it is to be understood that the terminology with has been used is intended to be in the nature of words of description rather than of limitation.

Obviously many modifications and variations of the present invention are possible in light of the above teachings. It is, therefore, to be understood that within the scope of the appended claims wherein reference numerals are merely for convenience and are not to be in any way limiting. The invention may be practiced otherwise than as specifically described.

What is claimed:

1. A method for the vacuum-assisted countergravity casting of molten metal from an underlying source of the molten metal into a mold cavity of an above-situated casting mold, said method comprising the steps of:

forming substantially horizontal distribution channels (30) in a top side (32) of a cheek mold (28) and an ingate passage (34) extending upwardly from a bottom side (36) of the cheek (28) and communicating with the distribution channels (30);

forming a plurality of feed gates (24) extending upwardly from a bottom side (26) of the mold (14) and into the cavity (22) of the mold (14);

positioning the bottom side (26) of the mold (14) into engagement with the top side (32) of the cheek (28) so that the feed gates (24) are in registry with the distribution channels (30) of the cheek (28);

applying a differential pressure between the mold cavity (22) and the source of metal (12) sufficient to urge the molten metal (12) upwardly through the ingate passage (34) and distribution channels (30) and then into the cavity (22) through the plurality of feed gates (24) to fill the cavity (22) with the molten metal;

and displacing the mold (14) on the cheek (28) once the cavity (22) has been filled in order to move the feed gates (24) out of registry with the distribution channels (30) for retaining the molten metal in the cavity (22) independently of the influence of the applied differential pressure.

2. A method as set forth in claim 1 further characterized by clamping the mold (14) against the cheek (28) to perfect a fluid-tight seal therebetween during filling of the mold (14) and while the mold (14) is being displaced on the cheek (28).

3. A method as set forth in claim 1 further characterized by conveying the casting mold (14) and cheek (28) as a unit into position above the underlying source of the molten metal (12).

4. A method as set forth in claim 3 further characterized by lowering the casting mold (14) and cheek (28) as a unit and immersing a feed stalk (42) connected to the ingate passage (34) into the underlying source of the molten metal (12).

5. A method as set forth in claim 1 further characterized by discontinuing the differential pressure once the mold (14) has been displaced and allowing the molten metal in the distribution channels (30) and ingate passage (34) to flow back into the underlying supply of molten metal (12).

6. A method as set forth in claim 5 further characterized by discontinuing the differential pressure after the mold (14) has been displaced and while the molten metal in the feed gates (24) is still molten.

7. An apparatus for a vacuum-assisted countergravity casting of molten metal, comprising:

a cheek mold member (28) having an ingate passage (34) extending upwardly from a bottom side (36) of said cheek (28) and generally horizontal outwardly extending distribution channels (30) formed in a top side (32) of said cheek (28) and communicating with said ingate passage (34);

a casting mold (14) having a cavity (22) therein and a plurality of feed gates (24) extending upwardly from a bottom side (26) of said mold (14) and into said cavity (22), said bottom side (26) of said casting mold (14) supported on said top side (32) of said cheek (28) with said feed gates (24) in registry with said distribution channels (30);

means for applying a differential pressure between said cavity (22) and an underlying supply of the molten metal (12) sufficient to urge the molten metal upwardly through said ingate (34) and said distribution channels (30) and then into said cavity (22) through said feed gates (24) to fill said cavity (22) with the molten metal;

and characterized by mold displacement means (66) for displacing said casting mold (14) on said cheek (28) once said cavity (22) has been filled and misaligning said feed gates (24) and said distribution channels (30) for retaining the molten metal in said cavity (22) independently of the applied differential pressure.

8. An apparatus as set forth in claim 7 further characterized by said cheek (28) and said casting mold (14) disposed within a vacuum box (40) and said mold displacement means (66) comprising a hydraulic ram (68) reciprocally slidable through a side wall (70) of said vacuum box (40) for sliding said mold (14) on said cheek (28).

9. An apparatus as set forth in claim 7 further characterized by mold clamping means (56) for clamping said mold (14) against said cheek (28) while permitting said mold (14) to slide on said cheek (28) when engaged by said mold displacement means (66).

10. An apparatus as set forth in claim 9 further characterized by said mold clamping means (56) comprising a hydraulic ram (58) reciprocally slidable through a top wall (60) of said vacuum box (40) for clampingly engaging an upper surface (64) of said mold (14).

11. An apparatus as set forth in claim 9 further characterized by said mold clamping means (56) being provided with rolling means (74) for rollably engaging said upper surface (64) of said mold (14).

12. An apparatus as set forth in claim 7 further characterized by said casting mold (14) comprising a cope portion (16) supported on a drag portion (18).

13. An apparatus as set forth in claim 7 further characterized by said ingate (34) including a feed tube (24) extending downwardly therefrom for immersion into the underlying source of a molten metal (12).

14. An apparatus as set forth in claim 7 further characterized by including means for moving said cheek (28) and said casting mold (14) vertically as a unit relative to the underlying source of the molten metal (12).

15. An apparatus as set forth in claim 7 further characterized by including conveyor means for conveying said cheek (28) and said casting mold (14) as a unit into and out of position over the underlying source of the molten metal (12).

16. An apparatus as set forth in claim 7 further characterized by said distribution channels (30) comprising depressions formed in said top side (32) of said cheek (28).

* * * * *